US005775487A

United States Patent [19]

Harrelson

[11] Patent Number: 5,775,487

[45] Date of Patent: Jul. 7, 1998

[54] BASKET-STYLE CARRIER WITH REINFORCED HANDLE

[75] Inventor: Glen R. Harrelson, Gainesville, Ga.

[73] Assignee: Riverwood International Corporation, Atlanta, Ga.

[21] Appl. No.: 769,824

[22] Filed: Dec. 19, 1996

[51] Int. Cl.[6] ..... B65D 5/462; B65D 71/58

[52] U.S. Cl. ..... 206/193; 229/117.14

[58] Field of Search ..... 206/176, 180, 206/184, 185, 186–193; 229/117.14

[56] References Cited

U.S. PATENT DOCUMENTS

| | | | |
|---|---|---|---|
| 2,772,020 | 11/1956 | Kramer | 206/180 |
| 2,846,114 | 8/1958 | Ringler | 206/184 |
| 4,217,983 | 8/1980 | Stout | 206/187 |
| 4,240,545 | 12/1980 | Stout | 206/189 |
| 4,253,564 | 3/1981 | Engdahl, Jr. | 206/187 |
| 4,286,709 | 9/1981 | Manizza | 206/176 |
| 5,579,904 | 12/1996 | Holley, Jr. | 206/187 |
| 5,611,425 | 3/1997 | Holley, Jr. | 206/193 |

*Primary Examiner*—Jimmy G. Foster
*Attorney, Agent, or Firm*—Arthur A. Gardner & Associates, PC

[57] ABSTRACT

A basket-style carrier for containing and carrying twelve containers or other articles includes first and second end panels opposite each other and first and second side panels opposite each other and connected to the end panels. A bottom is connected to the side panels and a central handle is positioned between the side panels. The central handle comprises six handle panels secured to one another, with the central handle being connected to the end panels. A plurality of partitions are connected to and extend between the central handle and the first and second side panels. The partitions define six 2-container cells. The central handle includes a foldable handgrip portion which is foldable between an upright position for carrying the carrier in which the handgrip portion extends above an uppermost portion of the end panels and a folded position adjacent the containers for stacking the carrier. The basket-style carrier includes a locking tab connected to one of the handle panels and extending through a tab opening in the bottom and secured to the bottom for increased carrying strength.

9 Claims, 5 Drawing Sheets

BASKET-STYLE CARRIER WITH REINFORCED HANDLE

FIELD OF THE INVENTION

The present invention relates to a basket-style carrier for carrying articles, such as beverage bottles. More particularly, the invention relates to a basket-style carrier with a reinforced handle for carrying twelve articles.

BACKGROUND OF THE INVENTION

One of the types of carriers commonly employed to package articles, such as beverage bottles, is the so-called "basket-style" carrier. These carriers typically include a number of partitions for defining separate cells for the bottles and a handle for carrying. They are easily lifted and carried, most have excellent strength, and the cell partitions tend to protect the bottles against contact with one another. If the bottles are not disposable, they can be returned for recycling in the original carrier since the carrier is not destroyed by removal of the bottles.

Among the basket-style carriers, a problem area is in the strength of the handle. It is quite common for the handles to tear or completely come loose from the remainder of the carrier, rendering the carrier unsatisfactory. This problem is especially troublesome if the carrier is to hold more than six bottles or if the carrier gets wet. It is known in the art that one can strengthen the carrier handle by increasing the paperboard thickness (caliber). However, this has the disadvantage of driving up the cost of the carrier, inasmuch as one of the predominate costs in making the carrier is the cost of the paperboard itself.

Typically, basket-style carriers have been provided for carrying up to six bottles or cans (usually bottles). Indeed, because of the somewhat limited handle strength, it has not been common for basket-style carriers to be designed for carrying twelve beverage bottles. One prior example of a 12-container basket-style carrier was used by a leading soft drink company to carry its very small (6 ounce) soft drink bottles. This 12-bottle carrier was a 2×6 configuration, that is there were six rows of two bottles per row, with all of the bottles being separated by partitions to avoid bottle-to-bottle contact. This carrier, while adequate for small size beverage bottles, apparently has not seen commercial application to normal size (16 ounce) bottles. It is believed that one of the factors working against the use of this style carrier for normal size bottles is the added stress placed on the handle due to the increased load bearing required by supporting and carrying twelve bottles.

Another type of 12-bottle basket-style carrier was previously made by the Mead Corporation and provided with three rows of cells, with each row having four cells therein. Each of the cells was divided from the other cells by fixed partitions, with some partitions running in one direction and other partitions running transverse thereto. It is believed that this carrier proved difficult to manufacture.

Accordingly, it can be see that a need yet remains for a basket-style carrier with a handle with increased strength, which is capable of carrying twelve bottles, and which can be provided economically. It is to the provision of such a carrier that the present invention is primarily directed.

SUMMARY OF THE INVENTION

Briefly described, in a preferred form the present invention comprises a basketstyle carrier for containing and carrying twelve containers or other articles. The container comprises first and second end panels opposite each other and first and second side panels opposite each other and connected to the end panels. A bottom is connected to the side panels and a central handle is positioned between the side panels. The central handle comprises six handle panels secured to one another, with the central handle being connected to the end panels. A plurality of partitions are connected to and extend between the central handle and the first and second side panels. The partitions define six 2-container cells.

Preferably, the central handle includes a foldable handgrip portion which is foldable between an upright position for carrying the carrier in which the handgrip portion extends above an uppermost portion of the end panels and a folded position adjacent the containers for stacking the carrier. Also preferably, the basket-style carrier includes a locking tab connected to one of the handle panels and extending through a tab opening in the bottom and secured to the bottom for increased carrying strength. Also preferably, the bottom comprises a large bottom panel connected to one side panel and a small bottom panel connected to the other side panel, with the large and small bottom panels secured to each other.

This construction is quite advantageous. Firstly, the central handle is greatly strengthened by the use of six handle panels. In the past, the central handle typically has been of a two-ply construction, while the present invention provides a six-ply handle construction. This greatly increases the strength of the handle, thereby overcoming a very significant drawback to typical basket-style carriers. Moreover, by making the handle a six-ply construction, rather than simply adding additional thickness throughout the entire construction of the carrier, a strong, yet economical carrier is provided. This additional strength is particularly helpful should the carrier become slightly wet. Also, the locking tab extending through the bottom and secured thereto provides increased strength.

By making the handle foldable, on the one hand the handle can be easily grasped from an upright position for grasping and carrying the basket-style carrier full of bottles or cans. On the other hand, for stacking the carrier on top of another carrier and continuing the stacking process, such as in manufacture and transport of the beverages, the handle can be folded over flat against the top of the bottles or cans to allow the carriers to be stacked, without buckling the handle (and thereby comprising the strength of the handle).

The arrangement according to the present invention avoids most bottle-to-bottle contact, but it does not eliminate all bottle-to-bottle contact.

Accordingly, it is an object of the present invention to provide a basket-style carrier having a handle with increased strength.

It is another object of the present invention to provide a basket-style carrier having a handle with improved strength while avoiding excessive additional manufacturing cost.

These and other objects, features, and advantages of the present invention will become more apparent upon reading the following specification in conjunction with the accompanying drawing figures.

BRIEF DESCRIPTION OF THE DRAWING FIGURES

DETAILED DESCRIPTION OF THE PREFERRED EMBODIMENT

Figure 1:
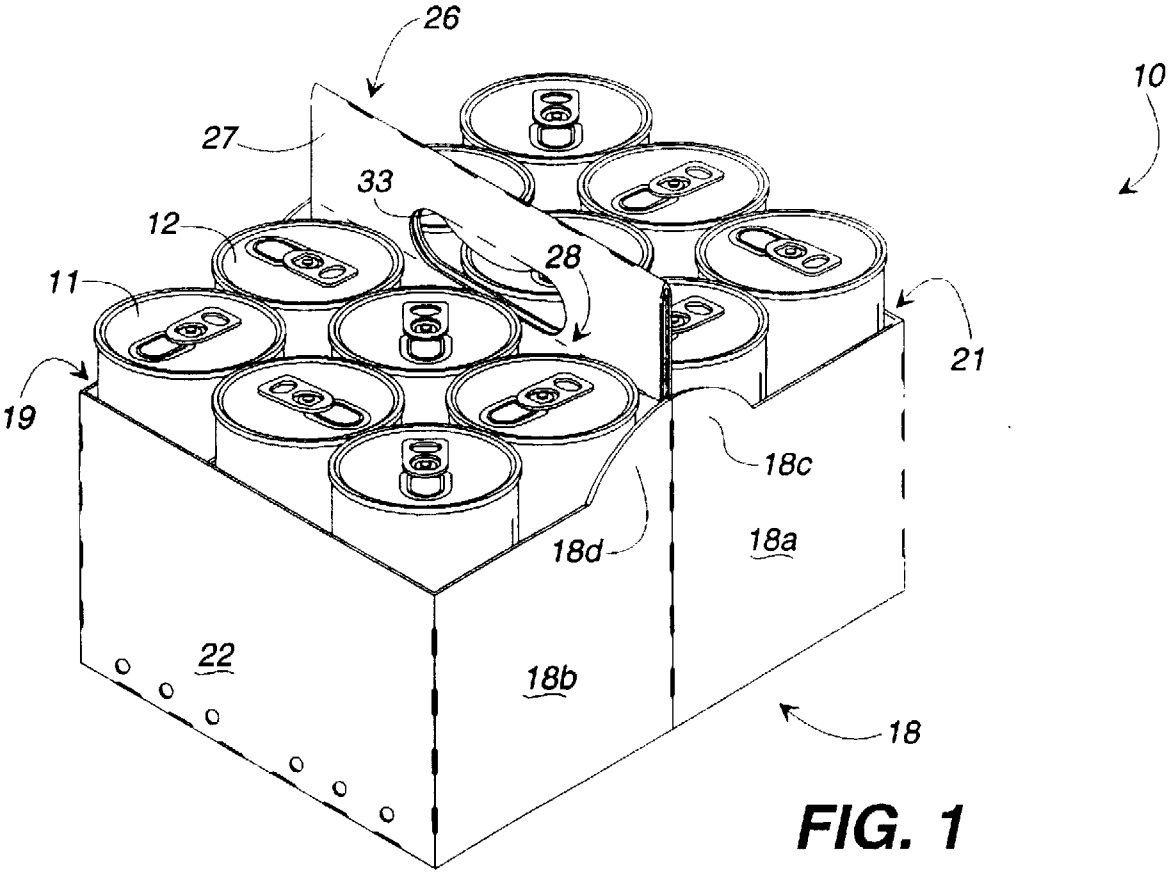
FIG. 1 is a perspective view of a basket-style carrier with a reinforced handle according to a preferred form of the invention, shown with twelve cans contained therein.

Referring now in detail to the drawing figures, wherein like reference numerals represent like parts throughout the several views, FIG. 1 shows a basket-style carrier 10 with a reinforced handle according to a preferred form of the invention. The basket-style carrier 10 according to the invention is specifically configured for carrying twelve containers, such as beverage bottles or cans. The carrier 10 includes six container cells for each holding two containers, such as cans 11 and 12, as depicted in FIG. 1.

As depicted in FIG. 1, the basket-style carrier 10 includes first and second end panels 18 and 19 positioned opposite each other. Each of the end panels 18, 19 comprises two half-panels, such as half-panels 18*a*, 18*b*. Optionally, each half-panel can include an upstanding, rounded reinforcing ear, such as reinforcing ears 18*c* and 18*d*. First and second side panels 21 and 22 are opposite each other and are connected to and extend between the end panels 18 and 19. Preferably, the height of the side panels and the end panels (including the optional reinforcing ears) is less than the height of the beverage bottles or beverage containers contained therein so that when the carriers are filled and stacked, the weight of the stack above a particular carrier is borne by the bottles or cans, rather than by the end panels and side panels of the carrier. This prevents the end panels and side panels from being crushed when the carriers are filled and stacked.

The basket-style carrier 10 also includes a central upstanding handle 26 to allow the carrier 10 to be grasped and carried. The central upstanding handle 26 is a six-ply construction and is connected to the first end panel 18 and the second end panel 19. The central upstanding handle 26 includes a large hand opening or grip opening 33 to allow the fingers of the user of the carrier 10 to be inserted therethrough for grasping and carrying the basket-style carrier 10. Those skilled in the art will recognize that while one handle opening is depicted, more than one handle opening could be provided, as desired.

Figure 7:
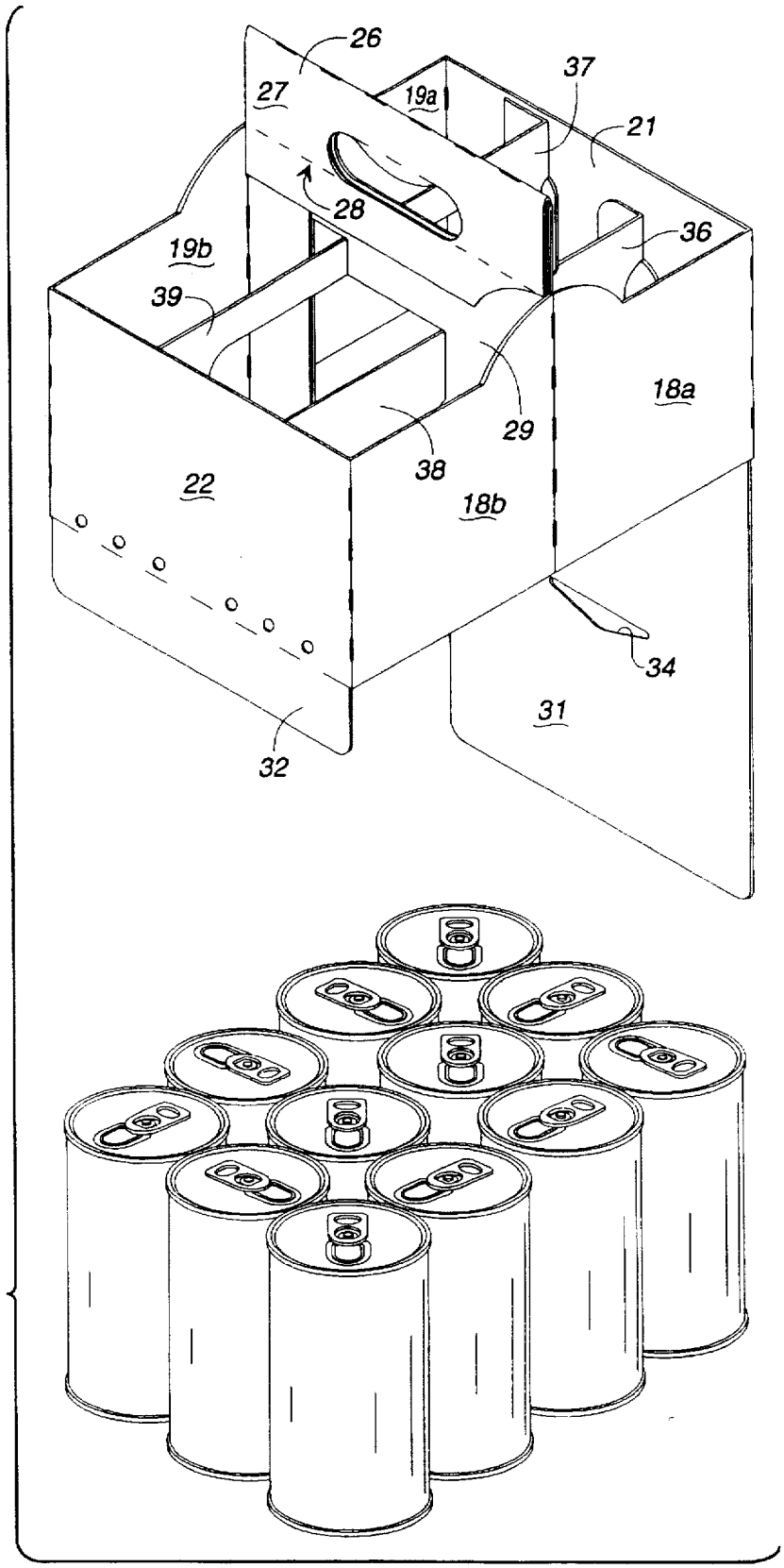
FIG. 7 is a perspective view of the carrier, ready for bottles to be inserted therein.

Still referring to FIG. 1, it can be seen that the central upstanding handle 26 extends the entire length of the basket-style carrier 10 and separates a first 6-pack of bottles or cans on one side of the handle 26 from a second 6-pack on the other side. Furthermore, as best seen in FIG. 7, partition straps 36 and 37 extend between the central handle 26 and the side panel 21. Likewise, partition straps 38 and 39 extend between the central handle 26 and the side panel 22. The partition straps 36–39 divide the carrier 10 into six 2-container cells and help to keep the bottles or cans separated from one another to minimize undesirable contact from bottles in one cell with bottles in another cell. Moreover, some of the weight (load) of the bottles or cans is transferred from the side panels 21 and 22 to the central handle 26 through the partition straps. Note that the individual cells are 2-container cells and that within each cell, the adjacent bottles can contact each other. However, most bottle-to-bottle contact is eliminated and the likelihood of damage from the limited bottle-to-bottle contact within each individual cell can be minimized by careful dimensioning of the cells relative to the diameter of the bottles.

Advantageously, the handle portion 26 includes a lower portion or skirt 29 which extends below the remainder of the central upstanding handle 26. The downwardly descending skirt 29 helps to minimize bottle-to-bottle contact between some of the bottles.

The handle 26 is scored along a foldline 28 to delineate an upper portion 27 from the remainder of the skirt 29. The foldline 28 allows the upper portion 27 to be folded over from the vertical orientation shown in FIGS. I and 7 to a horizontal configuration wherein the upper portion 27 of the handle lies adjacent the top of the bottles or cans. In the upright, extended configuration, the upper portion 27 of the handle extends above the tops of the cans or bottles to allow the carrier to be easily and quickly grasped and carried. With the upper portion 27 in its lowered or folded configuration, the carriers can be stacked for shipping the filled carriers or storing the filled carriers. In this way, the handle is not damaged or destroyed by an upper carrier being rested on the handle during stacking.

Referring again to FIG. 7, it can be seen that the carrier 10 also includes two bottom panels, in particular a large bottom panel 31 and a smaller bottom panel 32. The large bottom panel 31 is connected to side panel 21, while the smaller bottom panel 32 is connected to side panel 22. The large bottom panel 31 includes a tab opening 34 for receiving a locking tab, as will be described below. If the carrier is to be filled from the bottom, as depicted in FIG. 7, the bottom panels 31 and 32 are glued to each other after filling. Conversely, if the carrier 10 is to be filled from the top (not depicted in the figures), then the bottom panels are secured to one another prior to filling the carrier.

Figure 2:
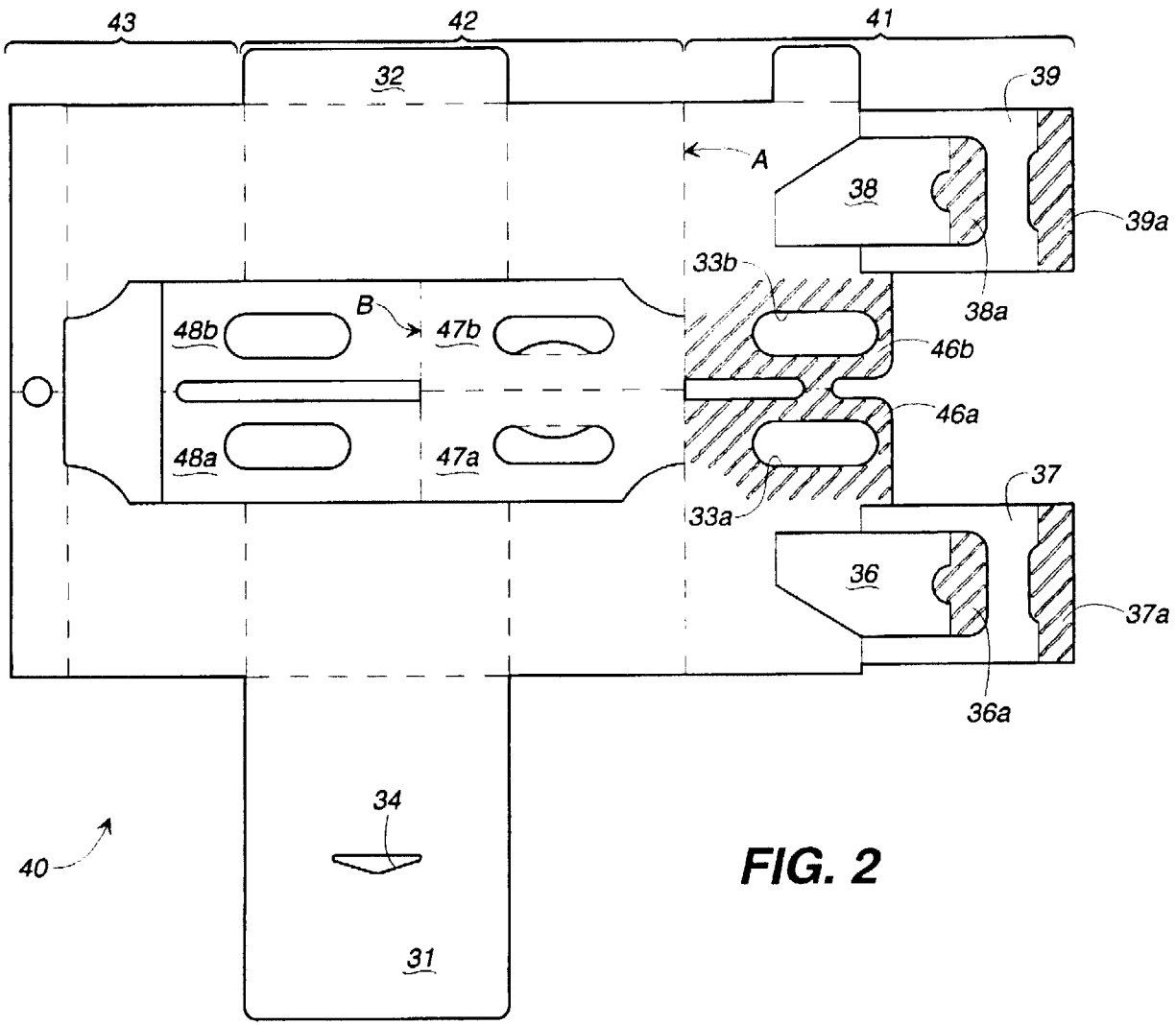
FIG. 2 is a plan view of a carrier blank for fabricating the carrier of FIG. 1.

Having now described the general construction of the basket-style carrier 10, attention is directed to FIGS. 2–6 which depict the manufacturing of the carrier 10 and will aid the reader in understanding better the details of the carrier. FIG. 2 depicts a blank 40 from which the carrier 10 is fabricated. The carrier blank 40 is precision cut and scored to allow the blank to be folded, glued and ultimately assembled into the finished carrier as depicted in FIGS. 1 and 7. The blank 40 is formed from paperboard of the type and caliber conventionally used in the carrier industry. The carrier blank 40 includes a first portion 41, a second portion 42, and a third portion 43. The carrier blank 40 depicted in FIG. 2 is shown with some glue or adhesive placed thereon preparatory to an initial folding step.

The first folding operation is the folding of the blank portion 41, including first and second handle panels 46*a*, 46*b*, about a foldline A onto the second blank portion 42. With adhesive previously having been applied to some portions of the first and second handle panels 46*a*, 46*b* as shown in FIG. 2, the first and second handle panels 46*a* and 46*b* are thereby adhered to third and fourth handle panels 47*a* and 47*b*. As can be seen in FIG. 2, the first and second handle panels 46*a*, 46*b* include handle openings 33a, 33b that align with a corresponding pair of handle openings 33*c*, 33*d* in the third and fourth handle panels when the first blank portion 41 is folded over onto the second blank portion 42.

The first blank portion 41 also contains the partitions 36–39. These partitions also include glue tabs 36*a*–39*a*. The glue tabs 36*a*–39*a* are provided with adhesive thereon and when the first portion 41 of the blank is folded over onto the second portion 42 of the blank, the glue tabs of the partitions are thereby secured to the second portion 42 of the blank.

Figure 3:
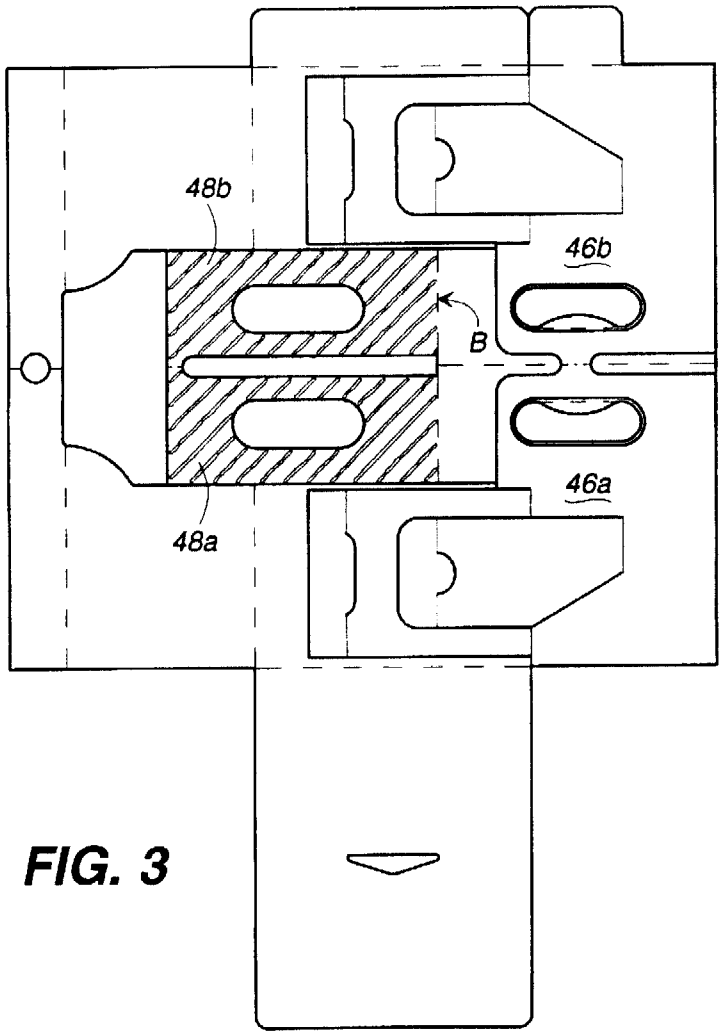
FIG. 3 is a plan view of the carrier blank of FIG. 2 after an initial folding step.

After the folding of the first portion 41 onto the second portion 42, the configuration of FIG. 3 is achieved. Adhesive is then applied to the fifth and sixth handle panels 48*a* and 48*b* and these handle panels are folded about foldline B onto the first and second handle panels 46*a* and 46*b*. By this folding about foldline B, the configuration of FIG. 4 is achieved.

Figure 4:
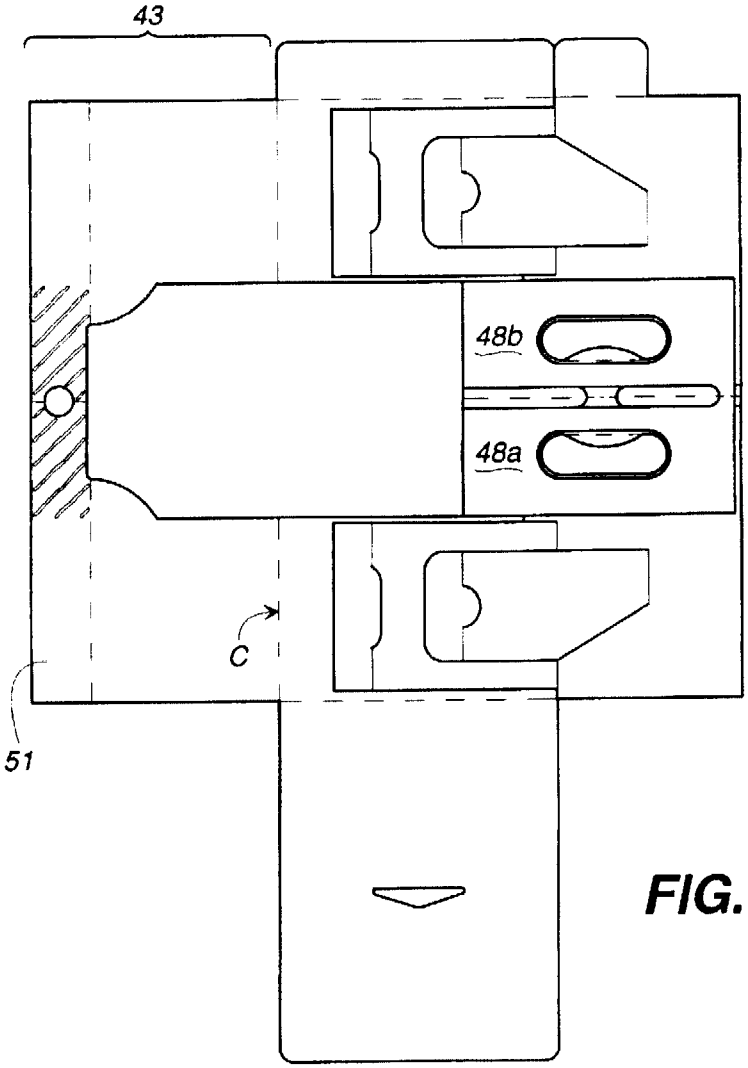
FIG. 4 is a plan view of the carrier blank of FIG. 3 after a second folding step.

As shown in FIG. 4, adhesive is then applied to a portion of a riser panel 51. The third portion 43 of the blank 10 is then folded about foldline C to secure the riser panel 51 to one end of the handle panels 48*a* and 48*b*. In this way, the configuration of FIG. 5 is achieved.

Figure 5:
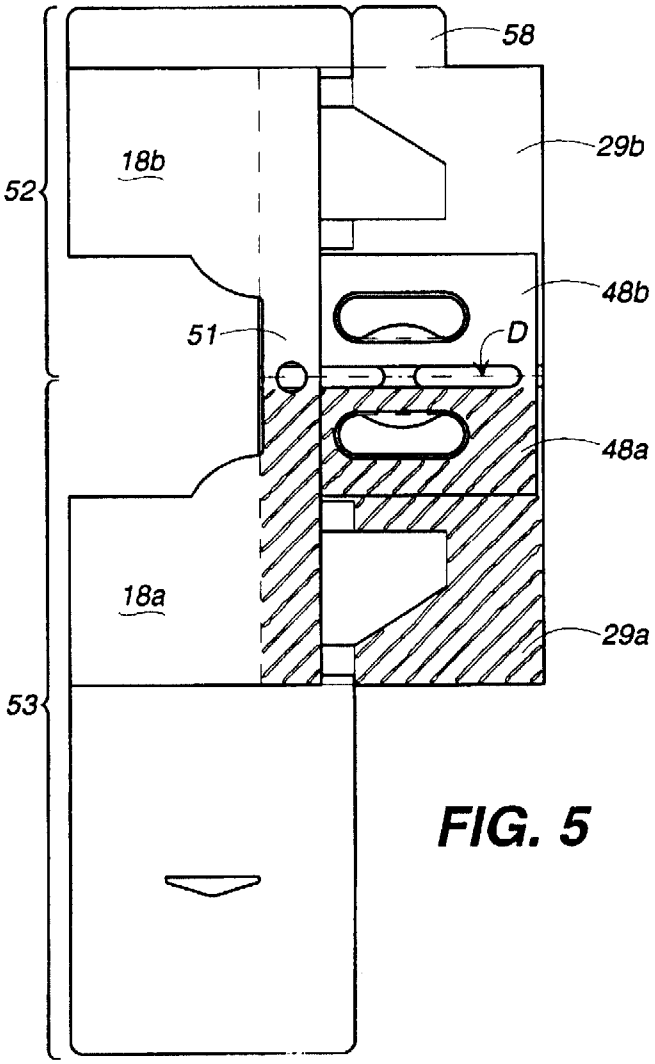
FIG. 5 is a plan view of the carrier blank of FIG. 4 after a third folding step.

Referring now to FIG. 5, it can be seen that the thrice-folded carrier blank 10 includes an upper portion 52 and a lower portion 53. The upper portion 52 is then folded about foldline D. In doing so, the adhesive applied to handle panel 48*a* secures it to handle panel 48*b*, thereby resulting in a six-ply handle in which the individual plies are secured to one another. Also, the riser panel 51, which has upper and lower halves, is adhered to itself to secure the half-panels 18*a* and 18*b* to each other to form the end panel 18. Also, the skirt portions 29*a* and 29*b* are adhered to each other to secure the skirt and to secure the end panels 19*a* and 19*b* to each other. In this way, the flat-folded, ready-to-be-filled, carrier of FIG. 6 is achieved.

Figure 6:
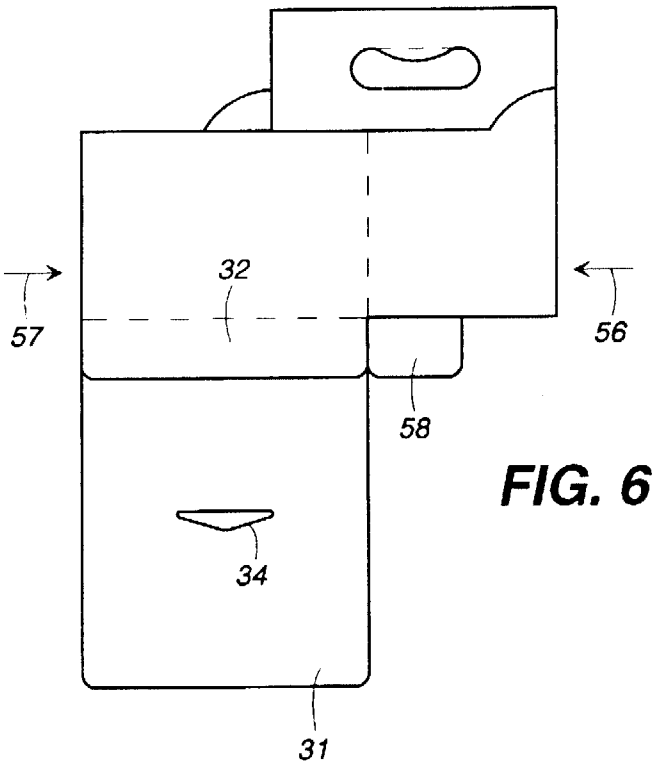
FIG. 6 is a plan view of the carrier blank of FIG. 5 after a fourth folding step.

To transform the substantially flat, substantially two-dimensional folded blank depicted in FIG. 6 into the expanded, ready-for-use carrier of FIG. 7, force is applied at the end of the folded blank along the direction of direction arrows 56 and 57. As this occurs, a tab 58 (see also FIG. 5) which is connected with the skirt 29 is moved to the center of the carrier ready to be inserted through the tab opening 34 upon folding of the large bottom panel 31 upwardly to form the bottom of the carrier. Adhesive is applied to the tab 58 and the tab is folded over against the bottom panel 31 to secure the skirt 29 to the bottom.

The central handle 26 is greatly strengthened by the six-ply construction. This increases the strength of the handle, thereby overcoming a significant drawback to traditional basket-style carriers, particularly for carrying twelve containers. Also, the tab 58 extending through and secured to the bottom of the carrier improves the strength of the carrier as well. This arrangement also is quite economical, not requiring that the entire basket-style carrier be made of higher caliber paperboard in order to increase the strength of the carrier.

While the invention has been disclosed in preferred forms, it will be apparent to those skilled in the art that many modifications, additions, and deletions may be made therein without departing from the spirit and scope of the invention as set forth in the following claims.

I claim:

1. A basket-style carrier for containing and carrying twelve containers or other articles, said carrier comprising:

two end panels opposite each other;

two side panels opposite each other and connected to said end panels;

a bottom connected to said side panels, said bottom having a tab opening formed therein;

a central handle comprising six handle panels secured to one another, with at least one of said handle panels being secured or connected to one of said end panels and with at least another one of said handle panels being secured or connected to the other of said end panels, said central handle including a predefined fold line defining a foldable handgrip portion which is foldable between an upright position for carrying said carrier in which said handgrip portion extends above an uppermost portion of said end panels and said side panels and a folded position adjacent the containers for stacking said carrier;

a locking tab connected to one of said handle panels and extending through said tab opening in said bottom, said locking tab being adhered to said bottom; and a plurality of partitions connected to said central handle and extending to said side panels, said partitions defining six 2-container cells.

2. A basket-style carrier for containing and carrying twelve containers or other articles, said carrier comprising:

first and second end panels opposite each other;

first and second side panels opposite each other and connected to said end panels;

a bottom connected to said side panels;

a central handle comprising six handle panels secured to one another, said central handle being connected to said end panels, wherein said central handle comprises a predefined score line delineating an upper portion which is foldable between an upright grasping position and a folded, stacking position; and a plurality of partitions connected to said central handle and extending from said central handle to said first and second side panels.

3. A basket-style carrier as claimed in claim 2 wherein said central handle comprises a predefined fold line delineating an upper portion which is foldable between an upright grasping position and a folded, stacking position.

4. A basket-style carrier as claimed in claim 2 wherein said central handle includes a handle opening and a skirt below said handle opening, said skirt helping to prevent at least some articles placed in said carrier from contacting one another.

5. A basket-style carrier as claimed in claim 2 wherein each of said six handle panels includes at least one handle opening and wherein said handle openings in said six handle panels are at least substantially aligned with each other.

6. A basket-style carrier as claimed in claim 2 wherein said plurality of partitions comprises first and second partitions connected to one of said six handle panels and extending to said first side panel and third and fourth partitions connected to another of said six handle panels and extending to said second side panel.

7. A basket-style carrier as claimed in claim 2 wherein said central handle panel extends beyond an uppermost portion of said end panels.

8. A basket-style carrier for containing and carrying twelve containers or other articles, said carrier comprising:

first and second end panels opposite each other;

first and second side panels opposite each other and connected to said end panels;

a bottom connected to said side panels;

a central handle comprising six handle panels secured to one another, said central handle being connected to said end panels;

a plurality of partitions connected to said central handle and extending from said central handle to said first and second side panels, said partitions defining six 2-container cells; and a locking tab connected to one of said handle panels and extending through a tab opening in said bottom and adhered to said bottom.

9. A basket-style carrier for containing and carrying twelve containers or other articles said carrier comprising:

first and second end panels opposite each other;

first and second side panels opposite each other and connected to said end panels;

a bottom connected to said side panels;

a central handle comprising six handle panels secured to one another, said central handle being connected to said end panels; and a plurality of partitions connected to said central handle and extending from said central handle to said first and second side panels, said partitions defining six 2-container cells, wherein said bottom comprises a large bottom panel connected to one of said side panels and extending to the other of said side panels and a small bottom panel connected to the other of said side panels and partially overlapping said large bottom panel, with said large and small bottom panels being adhered to one another.

* * * * *